US011180831B2

(12) United States Patent
Mann et al.

(10) Patent No.: US 11,180,831 B2
(45) Date of Patent: Nov. 23, 2021

(54) HIGH-STRENGTH ALUMINIUM-BASED ALLOY

(71) Applicant: OBSHCHESTVO S OGRANICHENNOY OTVETSTVENNOST'YU "OBEDINENNAYA KOMPANIYA RUSAL INZHENERNO-TEKHNOLOGICHESKIY TSENTR", Krasnoyarsk (RU)

(72) Inventors: Viktor Khrist'yanovich Mann, Krasnoyarsk (RU); Aleksandr Nikolaevich Alabin, Krasnoyarsk (RU); Aleksandr Yur'evich Krokhin, Krasnoyarsk (RU); Anton Valer'Evich Frolov, Krasnoyarsk (RU); Konstantin Vas'lievich Efimov, Krasnoyarsk (RU)

(73) Assignee: Obshchestvo S Ogranichennoy Otvetstvennost'Yu "Obedinennaya Kompaniya Rusal Inzhenerno-Tekhnologicheskiy Tsentr", Krasnoyarsk (RU)

( * ) Notice: Subject to any disclaimer, the term of this patent is extended or adjusted under 35 U.S.C. 154(b) by 182 days.

(21) Appl. No.: 16/617,422

(22) PCT Filed: May 30, 2017

(86) PCT No.: PCT/RU2017/000367

§ 371 (c)(1),
(2) Date: Nov. 26, 2019

(87) PCT Pub. No.: WO2018/222065

PCT Pub. Date: Dec. 6, 2018

(65) Prior Publication Data

US 2020/0087756 A1 Mar. 19, 2020

(51) Int. Cl.
*C22C 21/10* (2006.01)
*C22F 1/053* (2006.01)

(52) U.S. Cl.
CPC ..... *C22C 21/10* (2013.01); *C22F 1/053* (2013.01)

(58) Field of Classification Search
None
See application file for complete search history.

(56) References Cited

U.S. PATENT DOCUMENTS

2005/0034794 A1 2/2005 Benedictus et al.
2018/0274073 A1 9/2018 Mann et al.

FOREIGN PATENT DOCUMENTS

EP 1885898 B1 2/2008
RU 2288965 C1 12/2006
(Continued)

OTHER PUBLICATIONS

International Search Report and Written Opinion of PCT/RU2017/000367 by the International Searching Authority (ISA/RU), dated Feb. 21, 2018.

*Primary Examiner* — Adam Krupicka
(74) *Attorney, Agent, or Firm* — Baker & McKenzie LLP

(57) ABSTRACT

The invention relates to the metallurgy field, in particular to the production of aluminium-based cast materials, and can be used for producing crucial components under high-load conditions. The primary application is for components used in automotive engineering, sports equipment, etc. Proposed is an aluminium-based high-strength alloy, containing zinc, magnesium, calcium, metal, titan, and at least one element from the group consisting of silicon, cerium, nickel, zirconium and scandium, using defined concentrations of the constituents. The technical result of the invention is increased strength properties of the alloy and the products
(Continued)

made therefrom on account of the formation of secondary precipitates of a strengthening phase by means of dispersion hardening.

16 Claims, 3 Drawing Sheets

(56) References Cited

FOREIGN PATENT DOCUMENTS

| | | |
|---|---|---|
| RU | 2484168 C1 | 6/2013 |
| RU | 2610578 C1 | 9/2015 |
| RU | 2581953 C1 | 4/2016 |

HIGH-STRENGTH ALUMINIUM-BASED ALLOY

CROSS REFERENCE TO RELATED APPLICATIONS

This application is a U.S. National Stage entry of and claims priority to PCT International Application No. PCT/RU2017/000367, filed May 30, 2017, the entire contents of which are hereby incorporated by reference in its entirety.

FIELD OF THE INVENTION

The invention relates to the field of metallurgy of aluminum-based cast alloys and can be used for producing articles used in mission-critical designs operable under load, in the following applications: transport (to produce automotive components, including cast wheel rims), the sports industry and sports equipment (bicycles, scooters, training machines, etc.), as well as other branches of engineering and industry.

BACKGROUND

The most popular aluminum cast alloys are based on the Al—Si system. Usually, the main doping elements for strengthening alloys of the Al—Si system are copper and magnesium, while certain alloys use both of these elements (typical examples being 356 and 354 alloys). Tensile strength in the T6 state for 356 and 354 alloys normally does not exceed 300 and 380 MPa, respectively, which is their absolute maximum when using conventional shaped casting techniques. The said strength properties substantially depend on the iron concentration in the alloy. To achieve high strength properties, first of all fatigue, the iron concentration is limited (generally down to 0.08-0.12 wt. %) by utilizing pure primary aluminum grades. At higher iron concentrations, the elongation and fatigue property are reduced substantially.

Of the known high-strength cast aluminum alloys, alloys of the Al—Cu system further doped with manganese are notable. Here, AM5 alloys or 2xx alloys are particularly notable, attaining a tensile strength $\sigma$=400-450 MPa under condition No. T6 (Promyshlennye Alyuminievye Splavy (Industrial aluminum alloys)./Reference book./Alieva S. G., Altman M. B. et al. Moscow, Metallurgiya, 1984. 528 pp.). The drawbacks of these alloys include their relatively poor casting performance due to low casting properties, in particular a high tendency for hot cracking and low flowability, provoking many problems for the production of shaped castings and for permanent mold casting in the first place.

A material developed by RUSAL and disclosed in "High-Strength Aluminum-Based Alloy" (RU2610578 of Sep. 29, 2015) is known. The provided alloy contains 5.2-6.0 zinc, 1.5-2.0 magnesium, 0.5-2.0 nickel, 0.4-1.0 iron, 0.01-0.25 copper, 0.05-0.20 zirconium, and at least one element from the group consisting of 0.05-0.10 scandium, 0.02-0.05 titanium, and the remainder being aluminum. The material can be used to manufacture castings for automotive components and other applications with a tensile strength of about 500 MPa. The drawbacks of the provided material include low strength properties for hot mold casting at temperatures above 250° C., which is related to the coarsening of the eutectic component containing iron and nickel, imposing certain limitations to the mass production of castings.

Another high-strength alloy of the Al—Zn—Mg—Cu—Sc system for castings used for airspace and automotive applications is known, disclosed in the patent EP1885898B1

(Publ. Feb. 13, 2008, Bull. 2008/07) by Alcoa Int. The provided alloy containing 4-9% Zn; 1-4% Mg; 1-2.5% Cu; <0.1% Si; <0.12% Fe; <0.5% Mn; 0.01-0.05% B; <0.15% Ti; 0.05-0.2% Zr; 0.1-0.5% Sc can yield high-strength castings (100% higher than the A356 alloy) using the following casting methods: low-pressure casting, gravity casting, piezocrystallization casting, etc. Among the drawbacks of the present invention, particular attention should be paid to the lack of eutectics forming elements in a chemical composition (when an alloy structure is substantially an aluminum solution), thus inhibiting relatively complex shaped castings to be produced. In addition, the chemical composition of the alloy comprises a limited amount of iron, which requires relatively pure primary aluminum grades to be used, as well as the presence of a combination of small additives of transition metals including scandium, which is sometimes unreasonable (for example, for sand casting due to the low cooling rate).

The alloy closest to the proposed invention is the high-strength aluminum-based alloy disclosed in patent RU 2484168C1 by NUST MISIS (Publ. Jun. 10, 2013, Bull. No. 16). The provided material consists of doping elements in the following ratios (wt. %): 7-12% zinc, 2-5% calcium, 2.2-3.8% magnesium, 0.02-0.25% zirconium, and the remainder being aluminum. The material hardness is at least 150 HV, tensile strength ($\sigma$) is at least 450 MPa, and yield point ($\sigma$0.2) is at least 400 MPa. The material can be used for producing articles operated under high loads at temperatures up to 100-150° C., including parts of aircrafts, automobiles and other means of transportation, parts of sports equipment, etc. The drawbacks of the provided material include high claimed concentrations of magnesium, leading to high overstress of the aluminum solution matrix and, as a result, reduced elongation values. Another shortcoming of the material is no reference to the admissible iron concentration.

DISCLOSURE OF THE INVENTION

The present invention provides a new cast aluminum alloy characterized by high strength upon shaped casting in a metallic die, and high mechanical properties (tensile strength, elongation, and fatigue properties) in conjunction with high performance (high flowability) upon shaped casting.

The technical effect obtained by the present invention meets the target of attaining high performance (flowability) due to the presence of a eutectic component in the alloy, and enhancing the strength properties of the alloy and articles produced therefrom due to the presence of secondary separations formed upon dispersion hardening.

The said technical result has been ensured by providing a cast aluminum-based alloy containing zinc, magnesium, calcium. The alloy further comprises iron, titanium, and at least one element from the group consisting of silicon, cerium and nickel, zirconium and scandium, with the following concentrations of the components, wt. %:

Zinc: 5-8;
Magnesium: 1.5-2.1;
Calcium: 0.10-1.9;
Iron: 0.08-0.5;
Titanium: 0.01-0.15;
Silicon: 0.08-0.9;
Nickel: 0.08-1.0;
Cerium: 0.10-0.4;
Zirconium: 0.08-0.15;
Scandium: 0.08-0.15;

Aluminum: the remainder;

with at least 4.0 wt. % zinc content in the aluminum solution and/or in secondary separations.

In certain embodiments, calcium may be present in the structure in the form of eutectic components with zinc, iron, nickel and silicon, having a particle size of no more than 3 μm.

Moreover, the high-strength alloy may include aluminum produced by electrolysis using an inert anode, and zirconium and titanium are substantially in the form of secondary separations having a size of up to 20 nm and the $L1_2$ crystal lattice.

In certain embodiments, the alloy may be produced in the form of castings by low- or high-pressure casting, gravity casting, and piezocrystallization casting.

SUMMARY OF THE INVENTION

The claimed range of doping elements ensures a high level of mechanical properties, provided that the structure of the aluminum alloy is an aluminum solution hardened by secondary separations of metastable strengthening phases and a eutectic component containing calcium, nickel, and one element from the group consisting of silicon, cerium and nickel.

The initial selection of the doping elements was based on an analysis of the corresponding phase rule diagrams, including the use of Thermo-Calc software. The criterion for selecting the concentration range was the absence of primary crystallization crystals containing zinc, calcium, iron, and nickel. The cerium alloys were obtained based on empirical data, as the corresponding phase rule diagrams are unavailable.

The justification of the claimed amounts of doping components ensuring the target structure in the alloy is presented below.

Zinc and magnesium in the claimed amounts are required to form the secondary separations of the strengthening phases due to dispersion hardening. At lower concentrations, the amount is insufficient to attain the target strength properties, while higher amounts may reduce elongation below the target level.

Upon crystallization, zinc is capable of redistributing among the structural components (aluminum solution, non-equilibrium eutectics $MgZn_2$ and eutectic phase $(Al,Zn)_4Ca$) in various ratios. The redistribution depends, first of all, on the concentration of zinc in the alloy, as well as on the concentrations of other doping elements. To attain significant strengthening due to secondary separations of metastable phases of the $MgZn_2$ type, the supersaturated aluminum solution after thermal treatment must contain at least about (wt. %) 4.0 zinc and 1.0 magnesium per supersaturated solution. Zinc concentration in the aluminum solution depends simultaneously on two ratios: 1) Zn/Ca ratio in the alloy, and 2) Ca/(Fe+Si+Ni) ratio.

Calcium, iron, silicon, cerium, and nickel are eutectics forming elements and are required in the claimed amounts to form a eutectic component, imparting high performance upon casting. Higher concentrations of calcium will reduce the strength properties by decreasing the zinc concentration in the aluminum solution while increasing the eutectic phase. At higher concentrations of iron, silicon and nickel, it is likely for primary crystallization phases to be generated in the structure, substantially deteriorating mechanical properties. At a content of eutectics forming elements (calcium, iron, silicon, cerium, and nickel) lower than claimed, there is a high risk of hot cracking in casting.

In the considered range of concentrations, calcium forms the following eutectic components:

With zinc: $(Al,Zn)_4Ca$;

With iron: $Al_{10}Fe_2Ca$;

With silicon: $Al_2Si_2Ca$;

With nickel: $Al_9NiCa$.

The claimed amounts of titanium are required to modify a hard aluminum solution. At a lower concentration, there is a risk of hot cracking. At a high concentration, there is high risk of primary crystals of a Ti-containing phase forming in the structure.

The following elements can be used as modifiers in addition to or instead of titanium: zirconium, scandium and other elements. In this case, the modification effect is attained by forming corresponding primary crystallization phases, which serve as seeds for primary crystallization of the aluminum solution.

For further strengthening, the provided material can be strengthened by adding zirconium and scandium. The claimed amounts of zirconium and scandium are required to generate secondary phases of $Al_3Zr$ and/or $Al_3(Zr,Sc)$, with the $L1_2$ lattice having an average size of up to 10-20 nm. At lower concentrations, the number of particles will be no longer sufficient for increasing the strength properties of casting, and at higher amounts, there is a risk of forming primary crystals ($D0_{23}$ crystal lattice), which adversely affects the mechanical properties of castings.

The claimed limit of the total amount of zirconium, titanium and scandium, which is no more than 0.25 wt. %, is based on the risk of developing primary crystals containing said elements which can deteriorate the mechanical characteristics.

EXEMPLARY EMBODIMENTS

Example 1

Six alloys were prepared in the form of castings with compositions listed in Table 1 below. The alloys were prepared in an induction furnace in graphite crucibles using the following charging materials (wt. %): aluminum (99.85), zinc (99.9), magnesium (99.9), and masters Al-6Ca, Al-10Fe, Al-20Ni, Al-10S, Al-20Ce, Al-2Sc, Al-5Ti, and Al-10Zr. The alloys were cast into the "bar" die type having a diameter of 22 mm with a massive riser (GOST 1583) at an initial mold temperature of about 300° C.

Strengthening after thermal treatment for maximum strength of the T6 temper mode (quenching in cold water and ageing) was evaluated by a tensile strength test. The tensile strength tests were performed on turned specimens with a 5 mm diameter and a 25 mm gage length. The testing rate was 10 mm/min. The concentrations of the doping elements were determined using the ARL4460 emission spectrometer. The zinc concentration in the aluminum solution and/or in the secondary separations was controlled by X-ray microanalysis with the FBI Quanta FEG 650 scanning electron microscope equipped with the X-MaxN SDD detector.

The results of the chemical composition and mechanical properties (under condition No. T6) are listed in Tables 1 and 2, respectively.

TABLE 1

Chemical composition of experimental alloys

| Alloy | Concentration in the Alloy, wt. % | | | | | | | Zn in |
|---|---|---|---|---|---|---|---|---|
| No. | Zn | Mg | Ca | Fe | Ti | Si | Al | (Al)* |
| 1 | 3.8 | 1.4 | 2.0 | 0.05 | 0.001 | 1.2 | The remainder | 0.8 |
| 2 | 5.0 | 1.5 | 1.6 | 0.25 | 0.08 | 0.3 | The remainder | 2.9 |
| 3 | 5.0 | 1.5 | 0.4 | 0.08 | 0.01 | 0.9 | The remainder | 4.2 |
| 4 | 5.8 | 1.8 | 0.8 | 0.3 | 0.05 | 0.08 | The remainder | 4.0 |
| 5 | 8.0 | 2.1 | 1.8 | 0.5 | 0.15 | 0.2 | The remainder | 5.0 |
| 6 | 8.2 | 2.3 | 0.05 | 0.6 | 0.18 | 0.01 | The remainder | 7.5 |

Zn in (Al)*is zinc concentration in the aluminum solution and/or secondary separations

TABLE 2

Mechanical properties of experimental alloys

| Alloy No. | σ, MPa | $\sigma_{0.2}$, MPa | δ, % |
|---|---|---|---|
| 1 | 202 | 142 | 8.1 |
| 2 | 258 | 167 | 7.3 |
| 3 | 364 | 270 | 5.5 |
| 4 | 391 | 283 | 4.6 |
| 5 | 405 | 307 | 4.1 |
| 6 | 415 | 321 | 0.3 |

Figure 1:
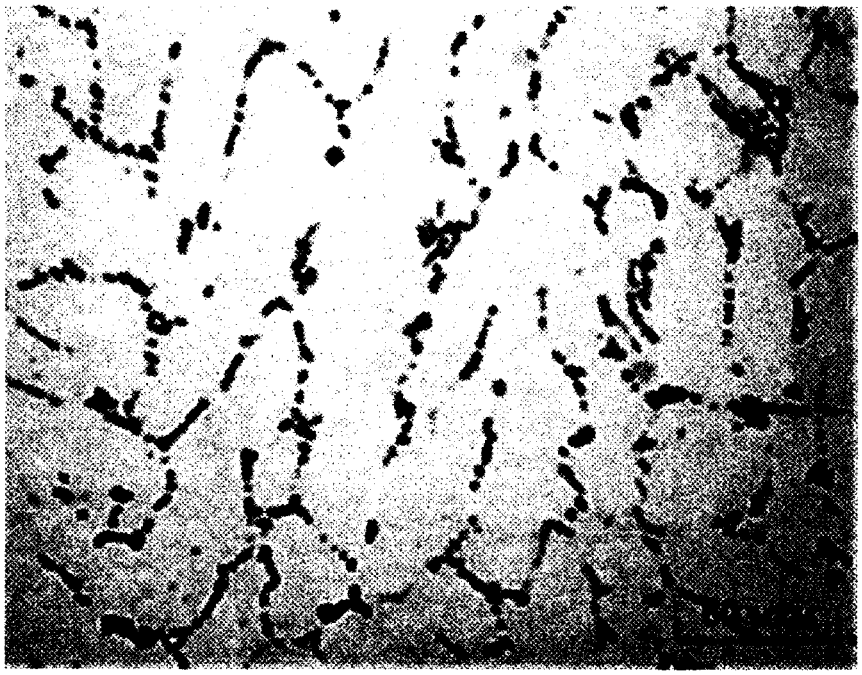
FIG. 1 shows a typical microstructure of a high-strength aluminum alloy, showing an aluminum solution with the calcium-containing eutectic component in the background.

An analysis of the results presented in Table 2 demonstrates that only the claimed alloy (compositions 3-5) provides the target tensile mechanical properties. High strength properties in conjunction with elongation are provided by beneficial morphology of calcium-containing eutectic phases in the background of the aluminum matrix, strengthened by secondary separations of the metastable phase $Mg_2Zn$. The structure of alloy No. 3 under condition No. T6 is typical for the considered concentration range and is shown in FIG. 1.

The compositions of alloys No. 1 and 2 do not provide the target mechanical properties; in particular, their tensile strengths do not exceed 202 MPa and 258 MPa, respectively, which is related to low volume fraction of $MgZn_2$ secondary phases of strengtheners due to low zinc concentration in the aluminum solution after thermal treatment for solid solution.

The composition of alloy No. 6 does not provide the target elongation, having a value below 1%, due to a large volume fraction of the coarse iron-containing phase.

Of the considered alloys, composition No. 4, as shown in Table 1, is most preferred for castings.

Example 2

To evaluate the effects of other elements comprised in the complex eutectics, the following compositions, as listed in Table 3, were prepared. Samples in the form of a bar with a 10 mm diameter were obtained by casting in a copper mold at 300° C. The results of the chemical composition and mechanical properties (under condition No. T6) are listed in Tables 3 and 4, respectively. The structures of alloys 7-1 and 7-2, as well as alloys 8-1 and 8-2, did not differ in essence.

TABLE 3

Chemical composition of experimental alloys

| Alloy | Concentration in the Alloy, wt. % | | | | | | | |
|---|---|---|---|---|---|---|---|---|
| No. | Zn | Mg | Ca | Fe | Ti | Ce | Ni | Al |
| 7-1 | 7.2 | 1.8 | 0.10 | 0.3 | 0.01 | 0.4 | — | The remainder |
| 7-2 | 7.1 | 1.8 | 0.10 | 0.15 | 0.01 | 0.2 | — | The remainder |
| 8-1 | 7.1 | 1.9 | 0.4 | 0.35 | 0.01 | 0.4 | — | The remainder |
| 8-2 | 7.1 | 1.9 | 0.4 | 0.25 | 0.01 | 0.2 | — | The remainder |

TABLE 4

Mechanical properties of experimental alloys

| Alloy No. | σ, MPa | $\sigma_{0.2}$, MPa | δ, % |
|---|---|---|---|
| 7-1 | 424 | 364 | 8.4 |
| 8-1 | 374 | 302 | 4.1 |

Example 3

To evaluate flowability, alloys No. 4 and No. 7-1 were cast in a spiral specimen and compared to 356 alloy. The temperature of the spiral molds was about 200° C.

Figure 2:
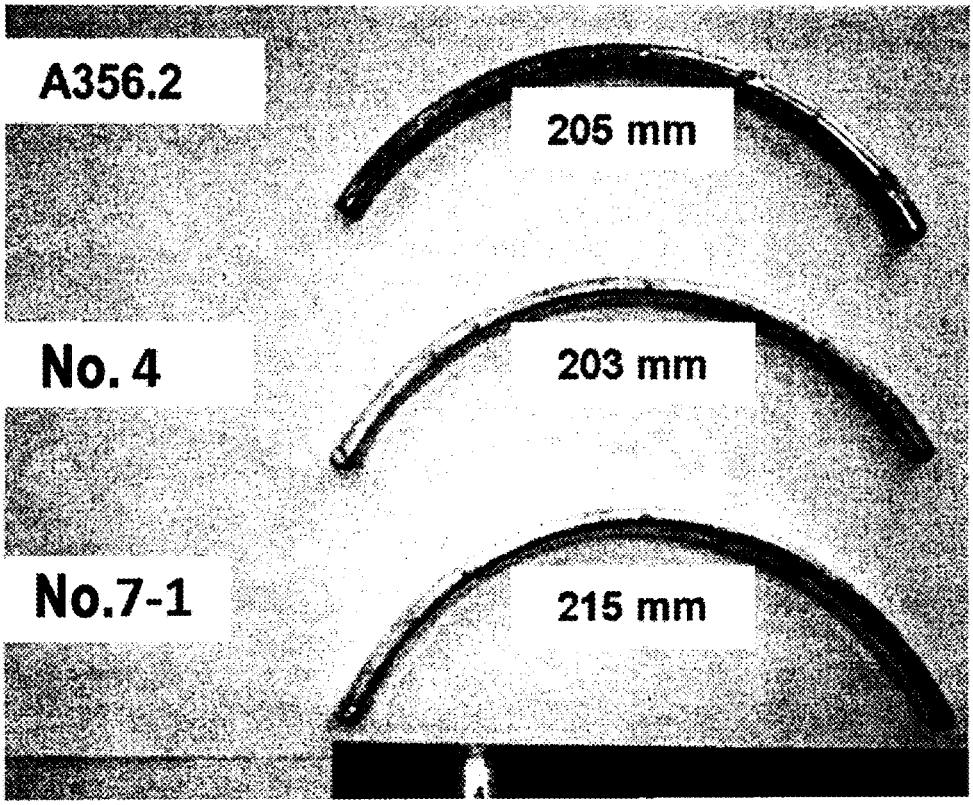
FIG. 2 shows test results for experimental alloys as compared to commercial A356.2 alloy.

The spiral castings made of the claimed alloy of composition 4 and 7-1, shown in FIG. 2, demonstrate that the provided materials are highly flowable and correspond to A356.2 alloy.

TABLE 5

Test results

| Item No. | Bar Length, mm |
|---|---|
| 4[1] | 203 |
| 7-1[2] | 215 |
| A356.2 | 205 |

[1]Composition 3 (see Table 1),
[2]composition 6 (see Table 3)

Example 4

The following zirconium and scandium additives were considered additional strengthening elements for the provided alloy. The considered chemical compositions are listed in Table 6. The effect of zirconium and scandium was evaluated using as an example the content of doping elements of alloy No. 3 from Table 1.

TABLE 6

Chemical composition of experimental alloys

| Alloy No. | Concentration in the Alloy, wt. % | | | | | | | | | |
|---|---|---|---|---|---|---|---|---|---|---|
| | Zn | Mg | Ca | Fe | Ti | Zr | Sc | Si | Al | Ti + Zr + Sc |
| 9 | 5.7 | 1.9 | 0.8 | 0.3 | 0.05 | 0.01 | — | 0.08 | The remainder | 0.06 |
| 10 | 5.9 | 1.8 | 0.8 | 0.3 | 0.05 | 0.12 | — | 0.08 | The remainder | 0.17 |
| 11 | 5.8 | 1.7 | 0.8 | 0.4 | 0.02 | 0.15 | 0.08 | 0.08 | The remainder | 0.25 |
| 12 | 5.9 | 1.7 | 0.8 | 0.3 | 0.02 | 0.08 | 0.15 | 0.08 | The remainder | 0.25 |
| 13 | 5.8 | 1.8 | 0.8 | 0.3 | 0.05 | — | 0.07 | 0.08 | The remainder | 0.12 |
| 14 | 5.8 | 1.8 | 0.8 | 0.3 | 0.05 | 0.08 | 0.15 | 0.08 | The remainder | 0.28 |

TABLE 7

Mechanical properties of experimental alloys

| Alloy No. | σ, MPa | $\sigma_{0.2}$, MPa | δ, % |
|---|---|---|---|
| 9 | 387 | 275 | 4.9 |
| 10 | 384 | 281 | 4.1 |
| 11 | 391 | 283 | 4.6 |
| 12 | 420 | 308 | 4.0 |
| 13 | 419 | 311 | 3.9 |

A microstructure analysis of alloys Nos. 9-13 demonstrated that, for the sum of Ti+Zr+Sc being no more than 0.25 wt. %, no primary $D0_{23}$ crystals containing these elements are observed in the structure, as opposed to alloy No. 14, where the sum of Ti+Zr+Sc was 0.25 wt. %. The presence of primary $D0_{23}$ crystals in the structure is unacceptable because of their negative impact on the mechanical properties.

An analysis of the tensile strength results shown in Table 7 demonstrated that only the concurrent addition of zirconium and scandium in alloys 10 and 11 provides additional strengthening. In this case, strengthening is provided by the formation of secondary separations of the $Al_3(Zr,Sc)$ phase with a $L1_2$ lattice.

The most preferred ratio of Ti, Zr and Sc to improve strengthening is the following: 0.02, 0.15 and 0.08 wt. %, respectively.

Example 5

To evaluate material strengthening without quenching in water, an alloy having the composition listed in Table 8 was considered in laboratory conditions.

TABLE 8

Chemical composition of the experimental alloy

| Alloy No. | Concentration in the Alloy, wt. % | | | | | | |
|---|---|---|---|---|---|---|---|
| | Zn | Mg | Ca | Fe | Ti | Si | Al |
| 15 | 7.0 | 1.0 | 1.9 | 0.25 | 0.08 | 0.08 | The remainder |

The strengthening was evaluated after annealing at 450° C. for 3 hours with air-cooling and subsequent ageing at 180° C. for 3 hours. The results of the tensile strength tests are provided in Table 9.

TABLE 9

Mechanical properties of the experimental alloy

| Alloy No. | σ, MPa | $\sigma_{0.2}$, MPa | δ, % |
|---|---|---|---|
| 13 | 348 | 258 | 4.9 |

Figure 3:
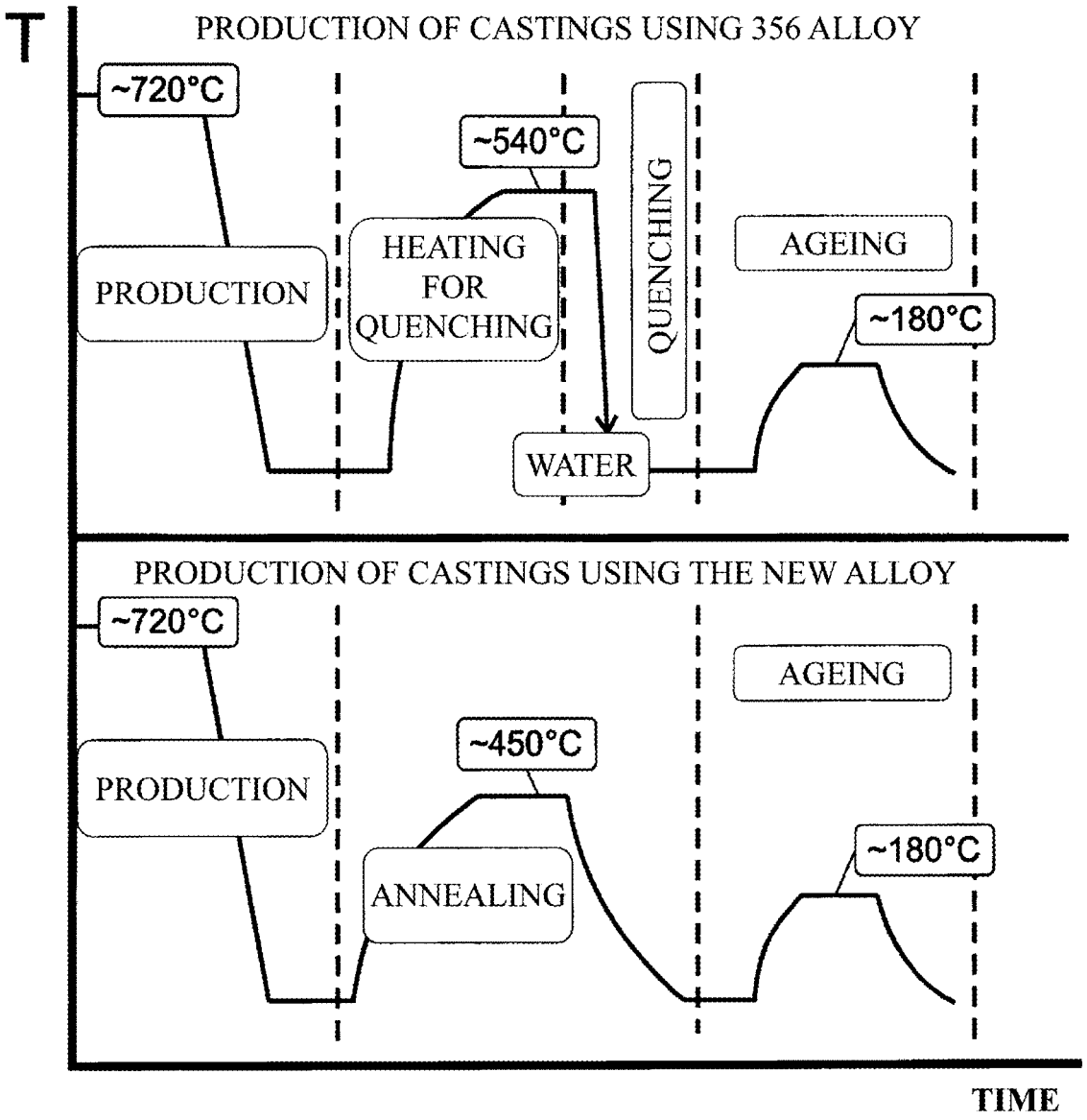
FIG. 3 shows a flow chart for producing castings using the provided alloy as compared to 356 alloy. The flow chart uses 356 alloy to demonstrate a typical scheme of casting production with subsequent thermal treatment, required to enhance strength properties and including operations of quenching in water (treatment for solid solution) with subsequent ageing. A particular feature of the provided material is that quenching in water can be excluded from the strengthening procedure. The required supersaturation of the solid solution with doping elements (zinc and magnesium) for the provided material can be obtained by heating at a temperature not exceeding 450° C. and subsequent air-cooling.

The results demonstrate that thermal treatment for solid solution without quenching in water can be used for the considered alloys, which significantly simplifies the production cycle of castings as compared to 356 alloy, where quenching in water is mandatory. The advantages of the new material are clearly demonstrated in FIG. 3.

Example 6

Figure 4:
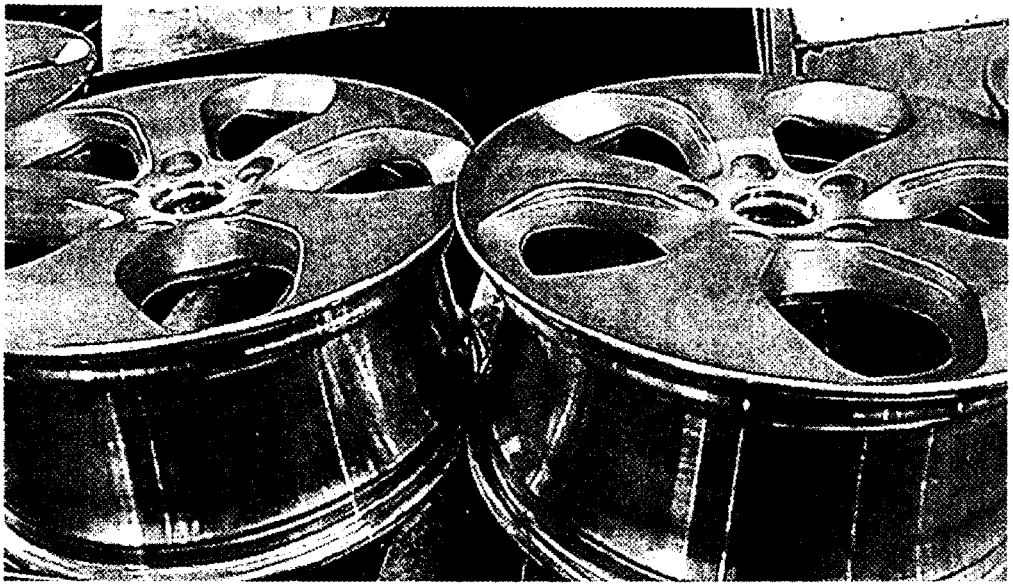
FIG. 4 shows an example of a cast wheel rim produced by low-pressure casting.

To evaluate performance for casting under production conditions, a 17" wheel rim (FIG. 4) was cast using claimed alloy composition 3 (Table 1) at the SKAD factory by low-pressure casting. The provided material demonstrated high casting performance, which allowed forming a rim, a hub portion, and spokes.

The provided aluminum alloy can also be used to produce other articles via deformation processing, in particular rolled sheets, pressed semifinished articles, forged products, etc.

Legal protection is claimed for the high-strength aluminum-based alloy consisting of zinc, magnesium, calcium, iron, titanium, and at least one element from the group consisting of silicon, cerium and nickel, zirconium and scandium, with the following concentrations of components in the alloy, wt. %:

Zinc (Zn): 5-8;
Magnesium (Mg): 1.5-2.1;
Calcium (Ca): 0.10-1.9;
Iron (Fe): 0.08-0.5;
Titanium (Ti): 0.01-0.15;
Silicon (Si): 0.08-0.9;
Nickel (Ni): 0.2-0.4;
Cerium (Ce): 0.2-0.4;
Zirconium (Zr): 0.08-0.15;
Scandium (Sc): 0.08-0.15;
Aluminum (Al): the remainder;

with the zinc content being at least 4 wt. % in the aluminum solution and in secondary separations.

Calcium may be present in the alloy structure in the form of eutectic components with zinc and iron, having a particle size of no more than 3 μm. Calcium may also be present in the alloy structure in the form of eutectic components with zinc, iron and silicon, having a particle size of no more than 3 μm. Calcium may also be present in the alloy structure in the form of eutectic components with zinc, iron and nickel, having a particle size of no more than 3 μm. Calcium may also be present in the alloy structure in the form of eutectic components with zinc, iron and cerium, having a particle size of no more than 3 μm.

It is advisable that zinc concentration in the aluminum solution is at least 5 wt. %.

The preferred ratios are Ca/Fe>1.1 and Ce/Fe>1.1.

The alloy may be produced in the form of castings by low-pressure casting, or gravity casting, or piezocrystallization casting, or high-pressure casting.

Importantly, the structure of the aluminum alloy is an aluminum solution hardened by secondary separations of metastable strengthening phases and a eutectic component containing calcium, nickel, and one element from the group consisting of silicon, cerium and nickel, with zinc and magnesium required to form secondary separations of the strengthening phases due to dispersion hardening, calcium, iron, silicon, cerium, and nickel being eutectics forming elements and required to form a eutectic component in the structure, imparting high casting performance, and titanium required to modify the solid aluminum solution.

Example 7

Figure 5:
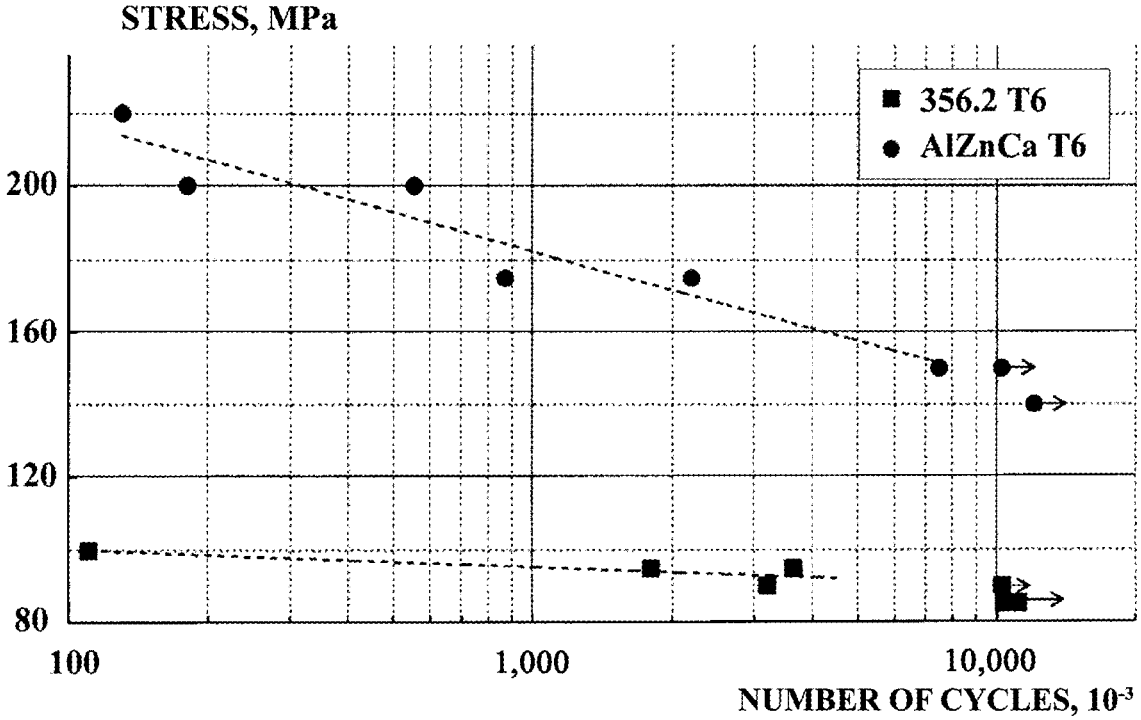
FIG. 5 shows a fatigue failure curve of the provided material as compared to A356.2 alloy.

A fatigue failure curve for alloy No. 4 and A356.2 alloy was obtained and is shown in FIG. 5. The fatigue tests were performed based on $10^7$ cycles in the pure bending scheme with symmetric loading. The tests were performed on the Instron machine, model R. R. Moor. The diameter of the working part was 7.5 mm. The tests were performed under condition No. T6 for both materials.

The results of $10^7$ cycles demonstrate that the fatigue limit of the provided material is more than 50% higher than that of the A356.2 alloy.

What is claimed is:

1. A high-strength aluminum-based alloy containing zinc, magnesium, calcium, iron, titanium, and at least one element from the group consisting of silicon, cerium and nickel, zirconium and scandium, with the following concentrations of components in the alloy, wt. %:

Zinc (Zn): 5-8;
Magnesium (Mg): 1.5-2.1;
Calcium (Ca): 0.10-1.9;
Iron (Fe): 0.08-0.5;
Titanium (Ti): 0.01-0.15;
Silicon (Si): 0.08-0.9;
Nickel (Ni): 0.2-0.4;
Cerium (Ce): 0.2-0.4;
Zirconium (Zr): 0.08-0.15;
Scandium (Sc): 0.08-0.15;
Aluminum (Al): the remainder;

with the zinc content being at least 4 wt. % in the aluminum solution and in secondary separations.

2. The alloy of claim 1, characterized in that calcium is present in the alloy structure in the form of eutectic components with zinc and iron, having a particle size of no more than 3 μm.

3. The alloy of claim 1, characterized in that calcium is present in the alloy structure in the form of eutectic components with zinc, iron and silicon, having a particle size of no more than 3 μm.

4. The alloy of claim 1, characterized in that calcium is present in the alloy structure in the form of eutectic components with zinc, iron and nickel, having a particle size of no more than 3 μm.

5. The alloy of claim 1, characterized in that calcium is present in the alloy structure in the form of eutectic components with zinc, iron and cerium, having a particle size of no more than 3 μm.

6. The alloy of claim 1, characterized in that zinc is present in the aluminum solution at a concentration of at least 5 wt. %.

7. The alloy of any of claims 1-6, characterized in that the ratio of Ca/Fe is >1.1.

8. The alloy of any of claims 1-6, characterized in that the ratio of Ce/Fe is >1.1.

9. The alloy of any of claims 1-6, characterized in that the sum of Ti+Zr+Sc does not exceed 0.25 wt. %.

10. The alloy of claim 1, characterized in that the alloy is produced in the form of castings by low-pressure casting.

11. The alloy of claim 1, characterized in that the alloy is produced in the form of castings by gravity casting.

12. The alloy of claim 1, characterized in that the alloy is produced in the form of castings by piezocrystallization casting.

13. The alloy of claim 1, characterized in that the alloy is produced in the form of castings by high-pressure casting.

14. The alloy of claim 1, characterized in that the alloy contains aluminum produced by electrolysis using an inert anode.

15. The alloy of claim 1, characterized in that zirconium and scandium are substantially in the form of secondary separations having a size of up to 20 nm and a $L1_2$ lattice.

16. The alloy of claim 1, characterized in that the structure of the aluminum alloy is an aluminum solution hardened by secondary separations of metastable strengthening phases and a eutectic component containing calcium, nickel, and one element from the group consisting of silicon, cerium and nickel, with zinc and magnesium required to form secondary separations of the strengthening phases due to dispersion hardening, calcium, iron, silicon, cerium, and nickel being eutectics forming elements and required to form a eutectic component in the structure, imparting high casting performance, and titanium required to modify the solid aluminum solution.

* * * * *